United States Patent [19]

Forrest

[11] 4,035,935

[45] July 19, 1977

[54] LAWN AERATING ATTACHMENTS FOR SHOES AND BOOTS

[75] Inventor: Robert Forrest, Winnipeg, Canada

[73] Assignee: Forrest Tool & Die Limited, Winnipeg, Canada

[21] Appl. No.: 751,044

[22] Filed: Dec. 16, 1976

[51] Int. Cl.[2] ..... A43B 23/00

[52] U.S. Cl. ..... 36/136

[58] Field of Search ..... 36/136, 113, 132, 61, 36/62

[56] References Cited

U.S. PATENT DOCUMENTS

| | | | |
|---|---|---|---|
| 1,132,208 | 3/1915 | Osaka | 36/61 |
| 2,045,066 | 6/1936 | Bower | 36/113 |
| 2,968,878 | 1/1961 | King | 36/61 |

*Primary Examiner*—Patrick D. Lawson
*Attorney, Agent, or Firm*—Stanley G. Ade

[57] ABSTRACT

A cross bar is provided with a pair of plug cutting tubes one at each end thereof and being edge sharpened at the lower edge. Plug release cut away portions are formed in the tubes spaced above the lower ends. The cross bar is secured to the underside of the shoes or boots against the heel step with each tube being situated slightly outboard of the sides of the soles. Walking on lawns or the like causes the plug tubes to cut cylindrical plugs from the lawn which are expelled upwardly and outwardly through the plug release cut away portions.

8 Claims, 5 Drawing Figures

LAWN AERATING ATTACHMENTS FOR SHOES AND BOOTS

BACKGROUND OF THE INVENTION

This invention relates to new and useful improvements in lawn aerating attachments for boots and shoes.

Many devices have been produced for aerating lawns, some of which are hand held and engaged by the sole of the foot in the manner of a fork and others which comprise cylindrical plug cutters secured to the undersurface of the sole of a boot or shoe. The latter suffer from several disadvantages, the principal one of which being that it is difficult to eject the plugs efficiently and another disadvantage is that when the lawn is dry, a plurality of such plug cutters is almost impossible to force downwardly into the lawn surface.

Furthermore, such devices are usually built into special shoes and boots and are therefore relatively expensive to manufacture.

SUMMARY OF THE INVENTION

The present invention overcomes these disadvantages by providing a relatively simple attachment for boots and shoes which is easily attached to any boot or shoe between the sole and heel portion thereof.

Another object of the invention is to provide a device of the character herewithin described which includes two tubes for each boot or shoe and which being situated approximately under the center of gravity of the wearer, are easily forced into the surface of the lawn when walking across same.

Another object of the invention is to provide a device of the character herewithin described in which the plug cutting tubes are provided with cut away portions so that the plugs of soil are forced upwardly and then outwardly as the user proceeds across a lawn or the like.

Yet another object of the invention is to provide a device of the character herewithin described in which the plug cutting tubes are situated slightly outboard of the outer edges of the sole thus not only giving efficient ejection, but also giving stability to the user.

A still further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
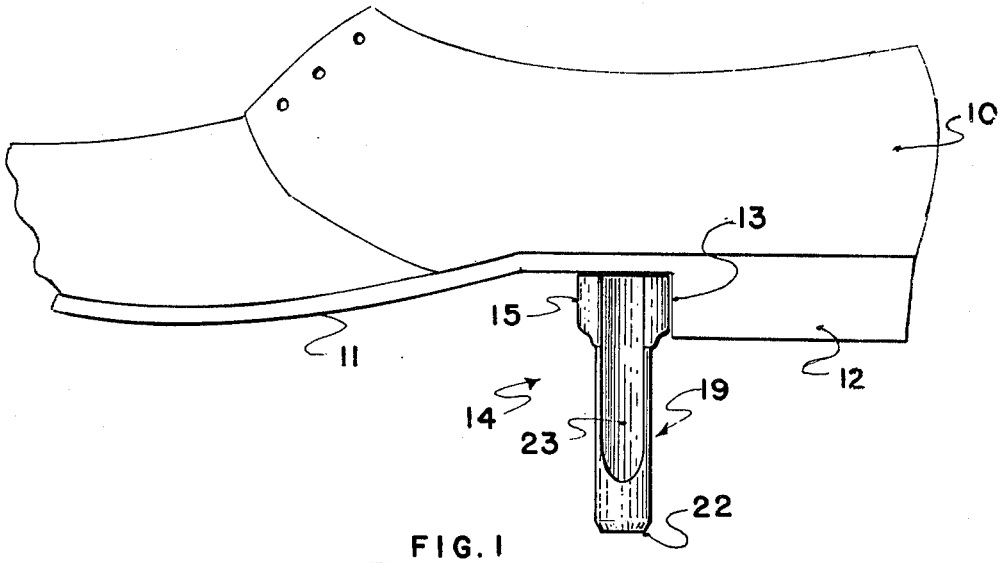
FIG. 1 is a side elevation of a shoe with the invention secured thereto.
Figure 2:
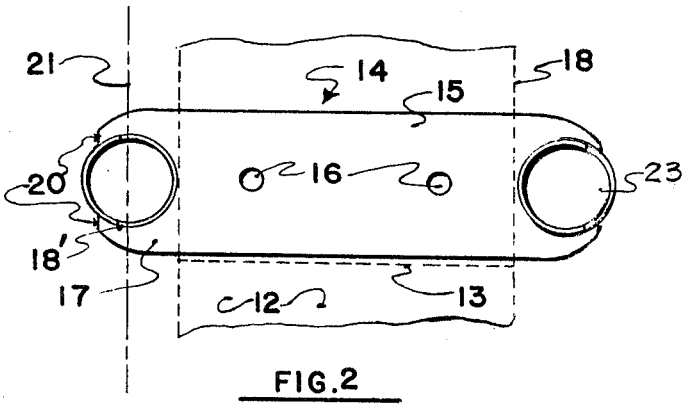
FIG. 2 is an underside view of the invention per se with a portion of the sole of the shoe shown in phantom.
Figure 3:
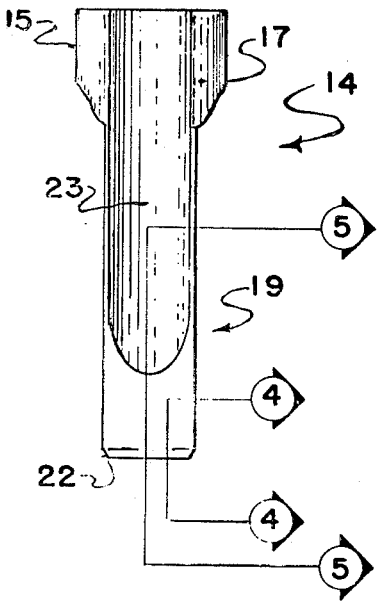
FIG. 3 is a side elevation of the invention per se.

Proceeding therefore to describe the invention in detail, reference should first be made to FIG. 1 which shows a side elevation of a shoe 10 having a sole 11 and a heel 12 with a vertical riser or step 13 extending between the undersurface of the heel 12 and the rear side of the sole 11.

The invention collectively designated 14, consists of a cross bar 15 which may be cast or forged or otherwise formed from a suitable metal or synthetic plastic.

This cross bar is provided with drillings 16 through which screws (not illustrated) may engage thus holding the cross bar to the underside of the sole and adjacent the step or riser 13.

The outer ends 17 of the cross bar extend slightly beyond the side boundaries 18 of the sole and these are formed into what are defined as substantially cylindrical tube receiving portions 18.

A plug cutting tube collectively designated 19 is secured within each of the tube receiving portions 18 by the upper ends of the tubes 19 and the extremities 20 of the tube receiving portions are swaged around slightly to grip and hold the tubes 19 frictionally within the tube receiving portions 18.

It will also be observed that the ends or extremities 20 of the tube receiving portions 18 extend beyond the central line 21 of the tubes. In other words, they wrap around the tubes for more than 180° and this prevents any tendency of outward displacement of the tubes relative to the cross bar 15.

Figure 4:
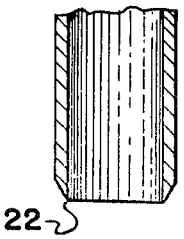
FIG. 4 is an enlarged fragmentary cross sectional view along the lines 4—4 of FIG. 3.
Figure 5:
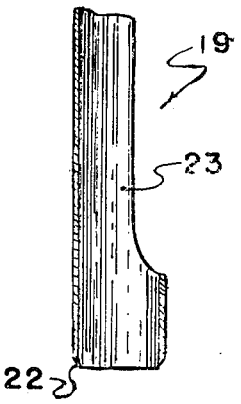
FIG. 5 is an enlarged fragmentary cross sectional view along the line 5—5 of FIG. 3.

Each tube 19 extends downwardly from the cross bar and is provided with an edge sharpened lower end 22 as shown in FIG. 4.

The major portion of the tube wall is cut away as indicated by reference character 23 and this cut away portion is situated outwardly relative to the cross bar 15.

This cut away portion acts as a plug release area during operation.

During manufacture, the tubes 19 are swaged or otherwise secured into the desired position and relationship with the ends of the cross bar 15 whereupon the cross bar may be secured to the underside of the sole 11 and adjacent the step 13 of the associated shoe 10.

The user then walks across the lawn to be aerated and his weight, acting directly over the longitudinal axis of the tubes, forces them into the soil and cuts a plug of soil which moves upwardly into the tubes 19. Continued walking causes other plugs to be cut and forced upwardly into the tubes thus ejecting former plugs upwardly and outwardly through the cut away areas 23 whereupon they fall upon the lawn surface.

It will therefore be appreciated that the use of the device will aerate a lawn rapidly and easily and that the tubes do not plug up or jam because of the cut away portions 23 and the fact that they are situated outboard of the side edges 18 of the sole. Furthermore the device can be worn when mowing the lawn thus accomplishing aeration at the same time.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A lawn aerating attachment for boots and shoes which includes a sole, a heel undersurface and a vertical riser between the front of the heel undersurface and the rear of the sole; comprising in combination a cross bar securable to the sole adjacent the vertical riser, and a plug cutting tube secured at each end of the cross bar and extending downwardly therefrom, each of said tubes including an edge sharpened lower end and means to facilitate discharge of earth plugs cut by said tubes, upwardly from said tubes.

2. The attachment according to claim 1 in which said means include the major portion of the outer side portion of the walls of said tubes being cut away thus forming plug release areas in each tube spaced upwardly from the said lower ends thereof.

3. The attachment according to claim 1 in which said cross bar includes a cylindrical tube receiving portion on each end thereof, the outer wall portion of said cylindrical tube receiving portion being cut away, said tube being held frictionally within said tube receiving portion by the upper end portion of said tube, whereby the distal ends of the tube receiving portion extends around the said upper ends of said tubes for more than 180° thereby preventing upward displacement of said tubes from said cross bar.

4. The attachment according to claim 2 in which said cross bar includes a cylindrical tube receiving portion on each end thereof, the outer wall portion of said cylindical tube receiving portion being cut away, said tube being held frictionally within said tube receiving portion by the upper end portion of said tube, whereby the distal ends of the tube receiving portion extends around the said upper ends of said tubes for more than 180° thereby preventing upwardly displacement of said tubes from said cross bar.

5. The attachment according to claim 1 in which said tubes are situated outboard of the sides of said sole when installed upon said boot or shoe.

6. The attachment according to claim 2 in which said tubes are situated outboard of the sides of said sole when installed upon said boot or shoe.

7. The attachment according to claim 3 in which said tubes are situated outboard of the sides of said sole when installed upon said boot or shoe.

8. The attachment according to claim 4 in which said tubes are situated outboard of the sides of said sole when installed upon said boot or shoe.

* * * * *